US005701885A

United States Patent [19]

Hale

[11] Patent Number: 5,701,885

[45] Date of Patent: Dec. 30, 1997

[54] PRESSURE EQUALIZING SCUBA DIVER MOUTHPIECE AND ACCESSORIES

[76] Inventor: Kelly T. Hale, 1613 Newfield La., Austin, Tex. 78703

[21] Appl. No.: 366,745

[22] Filed: Dec. 30, 1994

[51] Int. Cl.[6] ..... A62B 7/00

[52] U.S. Cl. ..... 128/201.26; 128/201.11; 128/207.14

[58] Field of Search ..... 128/201.11, 201.26, 128/201.18, 206.22, 206.21, 206.29, 207.12, 207.14, 207.15, 207.16, 207.17, 911

[56] References Cited

U.S. PATENT DOCUMENTS

| | | | |
|---|---|---|---|
| 1,132,138 | 7/1915 | Whitney | 128/204.16 |
| 3,107,669 | 10/1963 | Gross | 128/204.17 |
| 3,140,590 | 7/1964 | Gleockler | 128/204.15 |
| 4,014,384 | 3/1977 | Marcus | 128/204.17 |
| 4,230,106 | 10/1980 | Geestin et al. | 128/201.11 |
| 4,466,434 | 8/1984 | Browstein | 128/207.14 |
| 4,862,903 | 9/1989 | Campbell | 128/201.11 |
| 5,485,832 | 1/1996 | Joffity | 128/201.11 |
| 5,488,947 | 2/1996 | Frankel | 128/206.22 |

*Primary Examiner*—Vincent Millin
*Assistant Examiner*—William J. Deane, Jr.
*Attorney, Agent, or Firm*—Joseph F. Long

[57] ABSTRACT

A scuba diver mouthpiece that is held in place between users' molars and bicuspids using flexible partially fluid filled retention arm segments with an offset in the mouthpiece and pressure equalizing channel between retention arm segments to allow comfortable use of the mouthpiece for prolonged periods of time. The disclosure further describes a variable sized breathing air humidifier and removable adapter for use with the mouthpiece.

5 Claims, 5 Drawing Sheets

PRESSURE EQUALIZING SCUBA DIVER MOUTHPIECE AND ACCESSORIES

BACKGROUND OF THE INVENTION

Since the advent of the invention of the self contained underwater breathing apparatus (S.C.U.B.A.) there have been many improvements in the ease of use and comfort of the equipment. Today, scuba diving is a safe and enjoyable hobby. The market for scuba diving is constantly increasing due to the new developments in ease of learning and safety.

SCUBA equipment consists of several parts such as first and second stage regulators, buoyancy compensator, and console. While most of the improvements in scuba gear that have taken place in recent years concern the dive console (i.e. dive computers) and the regulators, little attention has been paid to the actual mouthpiece.

Anyone who has scuba dived or snorkeled for any period of time knows that jaw discomfort is a very real problem in scuba diving or snorkeling. Also the cleanliness of the gear is a real problem. Today, with what we know about contagious diseases people are very concerned about cleanliness and the transmission of diseases. A third problem for scuba divers results from breathing of dry air from the high pressure air storage tank in the unit.

The jaw discomfort results from prolonged abnormal pressure on the temporomandibular joint. The temporomandibular joint or hinge is unusual in that a lower portion called the condyle is held by muscles only in a loose fitting upper cavity called the glenoid fossa. With the mouth in a relaxed position with the lower incisors in behind the upper incisors or when molars are used for grinding or chewing of food the condyle is solidly in place in the glenoid fossa with little muscle strain.

Objectives of the present invention include:

a) minimizing jaw discomfort using thin flexible partially fluid filled retention tubes on each side of the mouthpiece with a pressure equalizing channel between the tubes so that the mouthpiece is held between the molars and bicuspids with equal pressure on each side of the mouth. In use the thin partially fluid filled retention tubes conform to the space between the teeth so that little pressure is required for retention of the mouthpiece. Further the jaws will close to an essentially at rest position with less than 5/32 of inch between the molars.

b) providing an easily removable mouthpiece with adapters to fit to various scuba air hose fittings with manually removable and reusable friction tie straps in order that the user may readily remove and disinfect the mouthpiece before use.

c) providing a humidifier that fits between the mouthpiece and air hose so that air as it is breathed inward passes over and around and through a water filled sponge segment loosely contained in a corrugated tubular unit. A unit 1 ½" in diameter and 10" long, should be ample for most dives. Multiple units may be used.

There is a large body of prior art, perhaps attesting to the problems. U.S. Pat. No. 4,466,434 issued Aug. 21, 1984 to Brownstein, U.S. Pat. No. 5,031,611 issued Jul. 16, 1991 to Moles and U.S. Pat. No. 5,305,741 issued Apr. 26, 1994 to Moles appear to be the closet prior art.

Brownstein has addressed the problem of jaw discomfort by proper positioning of the jaw while holding the mouthpiece but uses retention members that appear to be held between only two molars on each side.

Our invention differs markedly from Brownstein in that retention or holder arms in our invention are partially fluid filled with an equalizing channel between arms and are long enough to go between all molars on each side of the face. In our unit there will be no fulcrum effect on the mandibular hinge as pressure in Brownstein would cause and since our unit extends full length of the molars and bicuspids and conforms to irregularities in the tooth surface less pressure will be required to firmly hold the unit. At the same time the pressure will be the same on either side even with marked tooth surface irregularities such as caused by a bridge. Our unit is similar to Brownstein in natural positioning of the teeth. Brownstein does not address breathing air humidification.

In U.S. Pat. No. 5,031,611 issued Jul. 19, 1991 and in U.S. Pat. No. 5,305,741 issued Apr. 26, 1994 Moles addresses the problem of mouth fatigue. In both patents he covers use of thermoreformable retention portions of a scuba mouth piece that are shaped by the users bite and then cross linked to give lasting semi-rigidity thus making an individually customized unit. This is quite different than our unit which may be mass produced and which is partially fluid filled to conform to the space between the teeth to give the advantages of an individually customized fit. Further since our unit has only an outside rib on the retention arms our unit should be more comfortable for a user. Our unit has the further advantage of equalizing the pressure on both sides of the jaw and is not limited to an exact one position bite as in Moles. Moles does not address the problem of air humidification.

SUMMARY OF THE INVENTION

The invention provides for an improved scuba diving mouth piece with accessories to allow quick removal of the mouthpiece, to allow connecting a users' individual mouthpiece to variously fitted scuba gear, and to provide for an in-line air humidifier to alleviate the dry breathing air problem.

The mouthpiece has thin tough plastic retention arms partially filled with fluid with an equalizing channel through the front portion of the mouthpiece. With these partially fluid filled retention arms the pressure is equalized on each side of the mouth. The retention arms are sized and partially filled with fluid so that in use the surface of the retention arms conform to spaces between the molars and bicuspids of the user thus requiring minimum pressure for holding the unit while the jaws are separated only about as much as the normally at rest position. The retention arms fit between the teeth essentially the same as customized individual fitted retention arms and act to refit themselves as the user changes jaw position and further act to keep equal pressure on each side of the jaws. Mouth fatigue is greatly reduced in that the retention arms may be partially fluid filled so that the jaws are close to an at rest position with minimal strain on the muscles holding the temporomandibular joint in its socket.

Adaptors to allow attaching the mouthpiece to various connectors on scuba breathing air hoses are included. A frictional type tie strap is included.

An air humidifier comprising a water absorbent sponge in a flexible hose approximately 1 ½ to 2" inches in diameter and 10–14" long with connections to fasten between the scuba mouthpiece and breathing air supply is included as a mouthpiece accessory.

DETAILED DESCRIPTION OF THE INVENTORY

The invention may best be described from the drawings.

Figure 1:
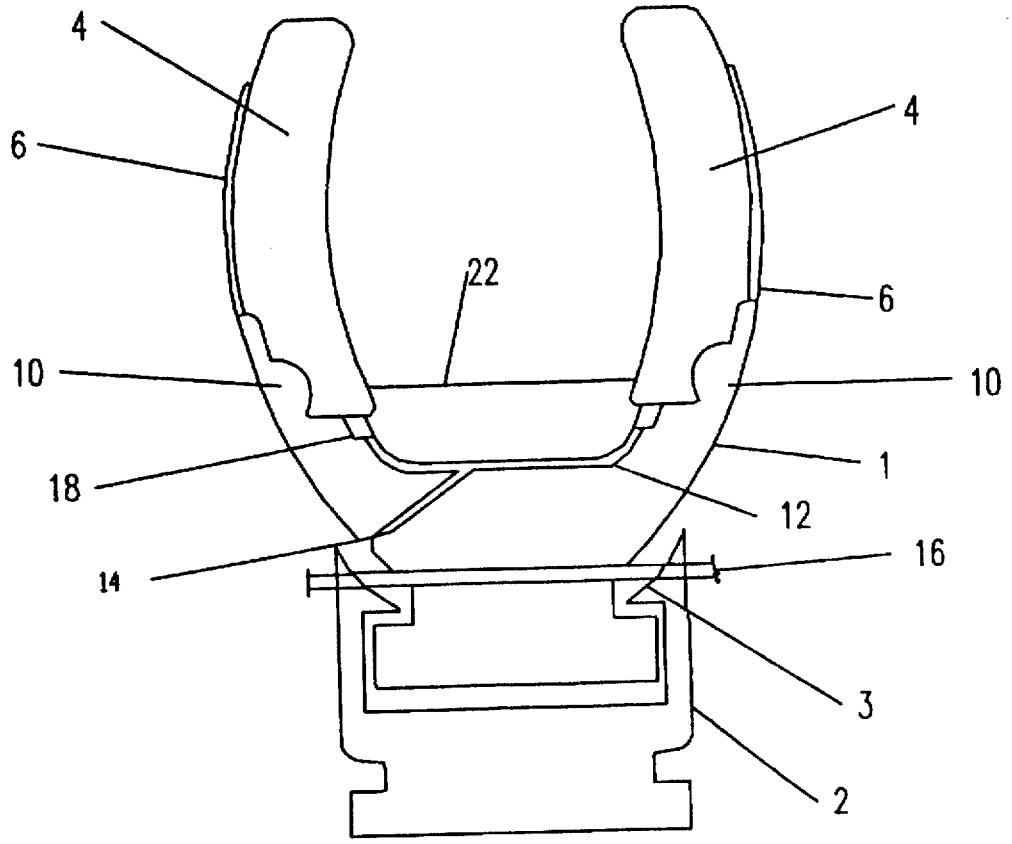
FIG. 1 shows a top view of the mouthpiece and an adapter.

In FIG. 1 we show a top view of a scuba divers mouthpiece 1 with the body and snap arms 10 preferably made of a semi-rigid plastic. Retention arms 4 with stiffening ribs 6 are preferably formed in a flattened tubular shape from a tough durable plastic such as Mylar or Nylon that is less than 1/16" thick. Many other plastics would be suitable. Each retention arm 4 is partially filled with a fluid, preferably a gel such as aloe vera with preservative therein and operatively connected by gluing or threading and gluing into connectors 18 leading to either end of pressure equalizing passageway 12. Screw 14 in a fluid addition channel may be removed to add or take out fluid from retention arms 4. When retention arms 4 are connected to connectors 18 ribs 6 on arms 4 are held in place in snap arms 10 that are integrally formed in the body. Offset 22 in the body serves to position a users' lower incisors slightly in back of the upper incisors. The mouthpiece is held in place by pressure from all the molars on either side of the users jaw. As the user bites down to hold the mouthpiece in place pressure is equalized in retention arms 4 and the surface of the retention arms closely conform to the surface of the molars and bite pressure to hold the mouthpiece is equalized with the teeth about 5/32 of an inch apart. In this position the temporomandibular hinge is in the position to have the least muscle strain to hold the unit. We've shown an adapter 2 with snap lip 3 held in place by tie strap 16, shown in more detail in FIG. 8 and 9. A user may have several adapters each shaped to connect to different hoses in different scuba gear. Tie strap 16 allows a user to easily remove his mouthpiece for cleaning and disinfecting.

Figure 2:
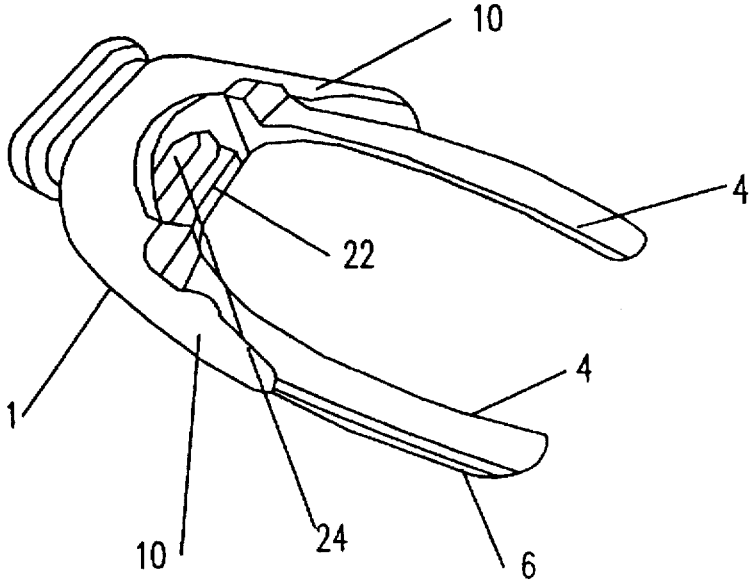
FIG. 2 shows a three dimensional view of the mouthpiece.

In FIG. 2 we show a three dimensional view to indicate more clearly how the partially liquid filled and relatively limpid arms 4 with stiffening rib 6 are joined in the body of mouthpiece 1 with snap arms 10 holding the stiffening rib 6. The shape with air passageway 24 and offset 22 indicates that there would be no pressure on the users incisors.

Figure 3:
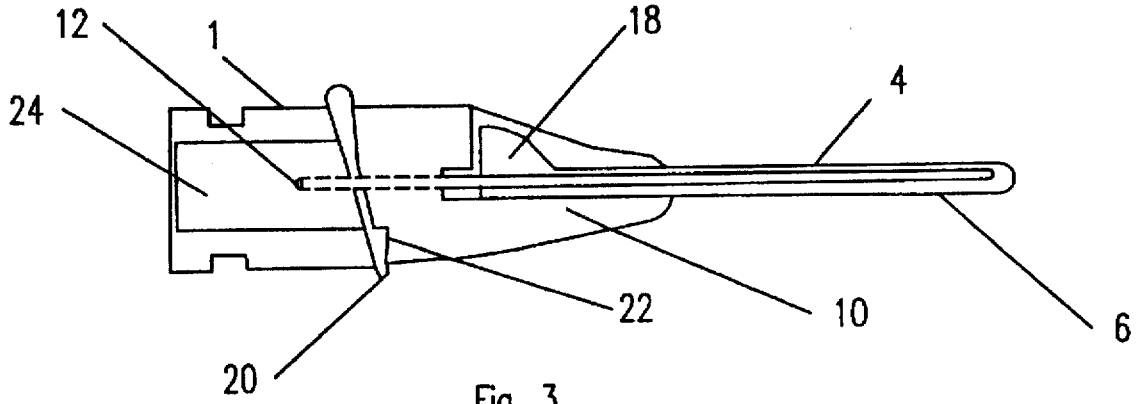
FIG. 3 shows a side view of the mouthpiece.

In FIG. 3 we show a side view of mouthpiece 1 to indicate lip flange 20, and how side arms 4 with reinforcing rib 6 and end connector 18 fits into the front portion of the body of the mouthpiece 1 and snap arms 10. Connection may be made by glueing or with some plastics by thermal welding. The connection may be further solidified by pins or with an added screw. (not shown) Dotted lines indicate pathway or passageway 12 that connects both retention arms 4 to allow equalization of pressure on each side of the mouth. Pressure tight screw closure 14 allows either addition or removal of fluid from the retention arms 4. This allows a user to adjust apparent thickness of arms 4 to give the most comfortable in use position. Breathing air passageway 24 and tooth positioning offset 22 are also indicated.

Figure 4:
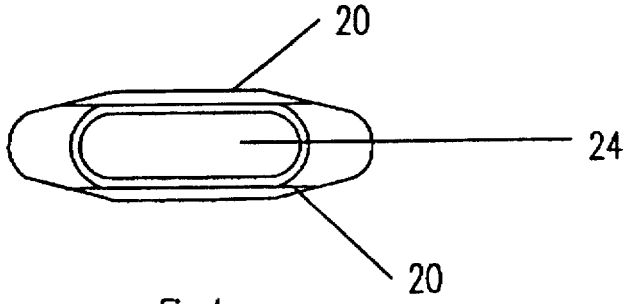
FIG. 4 shows a from view of the mouthpiece.

In FIG. 4 we've shown a from view of mouthpiece 1 to indicate preferred elongated shape of the breathing air inlet passageway 24 and the small lip flange 20 that helps the user to maintain a water tight seal when the mouthpiece is in use.

Figure 5:
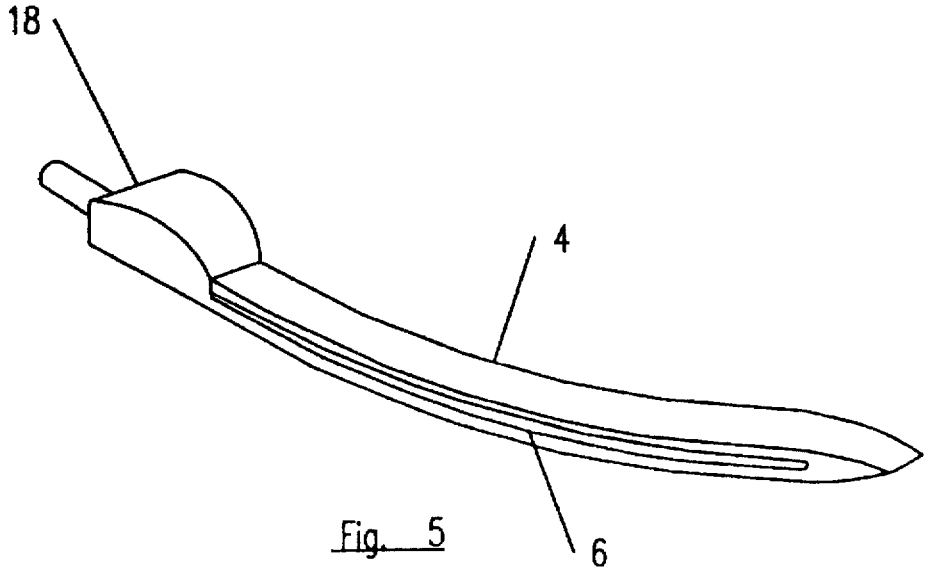
FIG. 5 shows a side view of the retention arm segment of the mouthpiece.

In FIG. 5 we've shown a side view of retention arm 4 with fib 6 indicating a preferred shape for connectors 18, which preferably is of a plastic that may be easily glued or welded to the main body pan of inlet or mouthpiece 1. The shape gives a large gluing area. Ann 4 may be integrally formed with connector 18 or glued or otherwise connected thereto.

Figure 6:
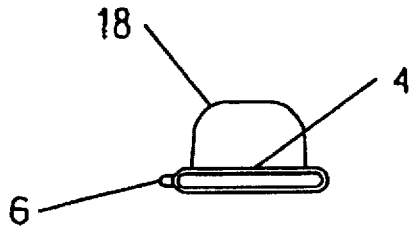
FIG. 6 shows a cross sectional segment A—A of the retention arm segment.

In FIG. 6 we've shown a cross section A—A indicating connector 18 and fib 6 integrally formed in arm 4 and relative shape in use of arm 4.

Figure 7:
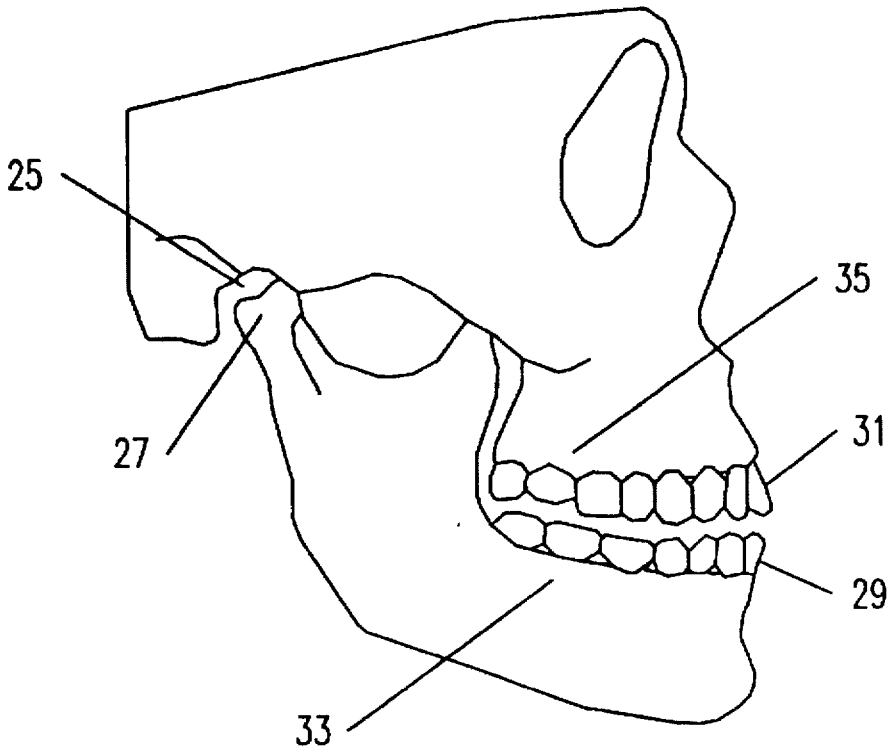
FIG. 7 shows a skull indicating that with lower incisors pulled forward the temporomandibular hinge tends to be pulled apart.

In FIG. 7 we've shown a skull view indicating that with top incisors 31 directly above the lower incisors 29 and molars 35 offset from molars 33 that the temporornandibularjoint which is formed by muscles holding the condyle 27 in the gienoid fossa 25 is in position to stretch the muscles of the joint.

Figure 8:
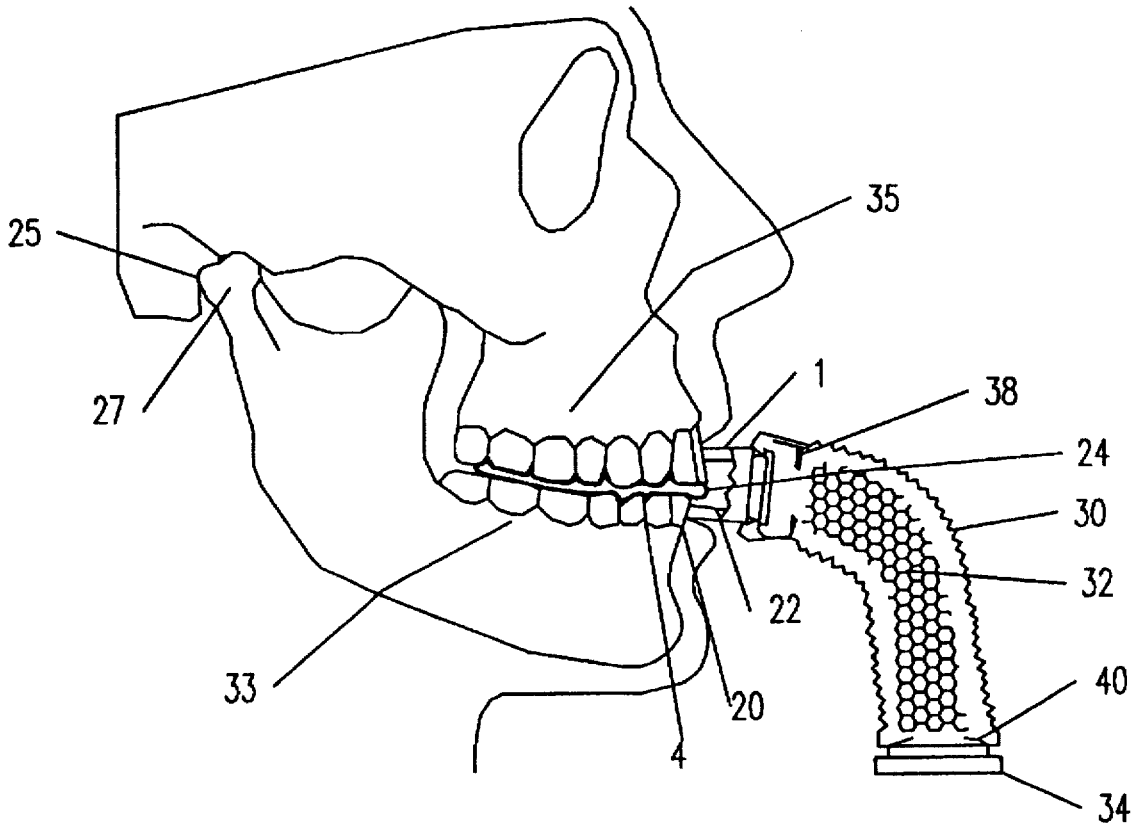
FIG. 8 shows a skull indicating that the temporomandibular hinge is comfortably in place in the socket with the mouthpiece in an in-use position.

In FIG. 8 we've shown that with mouthpiece 1 in the in-use position that offset 22 properly positions lower incisors slightly behind the upper incisors. With retention arm 4 being partially fluid filled and depressable to fit molar 33 and 35 and bicuspid contours minimum pressure per square inch is necessary to hold the mouthpiece in place. Further with retention arms 4 made of plastic of maximum of 1/16 thickness the user's jaw is almost in an at rest position and condyle 27 is in place in the gienoid fossa 27 with minimum muscle stress. Thus the temporomandibular joint is in the proper position to minimize muscle stress. As previously discussed the fluid which is preferably aloe vera gel but could be air is adjustable in mount or pressure to achieve minimum separation for each user. Pressure on each side of the jaw is equalized through fluid passageway 12, FIG. 1.

We've shown a humidifier 30 which is preferably formed from rubber or tough plastic with a corrugated side wall for flexibility. The humidifier is loosely filled with a segment of a water absorbent plastic sponge material 32 that is held in place by a fixed retainer ring 38 and a snap ring retainer 40 and allows air to flow through and around said sponge. The humidifier 40 may be held in place attached to mouthpiece 1 with the strap 16. Connector 34 on humidifier 30 is similar to the mouthpiece connector and may connect to the breathing air hose in the usual fashion. The humidifier 30 could be connected anyplace in the breathing air stream to humidify the air being used.

Figure 9:
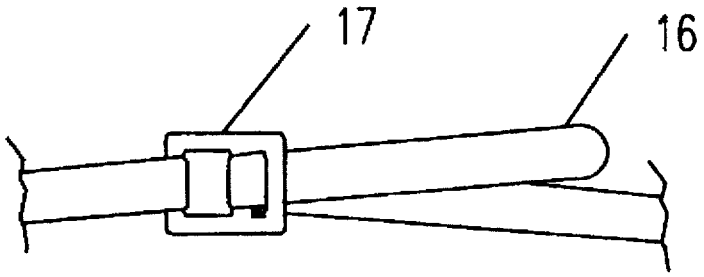
FIG. 9 shows a top view of a segment of a friction buckle type fie strap.

In FIG. 9 we've shown a friction type buckle 17 to be used in tie strap 16. Any of several types of plastic would be suitable for this tie strap.

Figure 10:
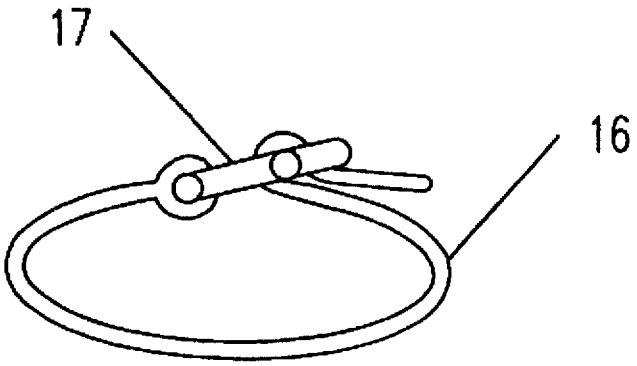
FIG. 10 shows a side view of the friction buckle tie strap.

FIG. 10 shows a friction buckle 17 in belt 16 that serves to tighten the belt while lifting the free side of buckle 17 will allow easy removal.

What is claimed is:

1. A pressure equalizing scuba diver mouthpiece with accessories comprising:

a) a body means;

b) a breathing air passageway through said body means;

c) a fluid equalizing passageway and a first connector means on a first end of said passageway and a second connector means on a second end of said passageway integrally formed in said body means;

d) a first and a second sealed pressure equalizing retention arm means with each extending between the molars on each side of a mouth and partially filled with fluid and connected to said first and said second connector means to allow said fluid to flow only between said first sealed retention arm means and said second sealed retention arm means;

e) a tooth positioning offset means in said body means acting to position a user's lower incisor teeth behind users' upper incisor teeth when said scuba divers mouthpiece is held in an in-use position in said users' mouth.

2. A pressure equalizing scuba diver mouthpiece with accessories as in claim 1 further comprising as air humidifier means removably connected to said body means and acting to humidify air moving through said breathing air passageway; said air humidifier means comprising a water absorbent sponge loosely held in place in a flexible corrugated tube to allow air to pass through and around said sponge; said tube being fitted with adapter means to allow fastening said humidifier means between said body of said mouthpiece and an air tube leading to a breathing air cylinder.

3. A pressure equalizing scuba diver mouthpiece with accessories as in claim 1 wherein a fluid addition channel means operatively connects to said fluid equalizing passageway to allow addition to and withdrawal of said fluid in said sealed retention arm means.

4. A pressure equalizing scuba diver mouthpiece with accessories comprising:

a) a body means that when held in a usable position inside a users' mouth with partially fluid filled sealed retention arm means with said retention arm means being in fluid communication with each other and extending the length of said molars, allow said body to be held with equal pressure by molars on each side of said users' mouth and to be held with both condyles solidly in place in glenoid fossas of both temporomandibular hinges of said user; and b) an air humidifier means in a breathing air passageway to said body means.

5. A pressure equalizing scuba diver mouthpiece with accessories comprising:

a) a body with breathing air passageway through a frontal portion of said body;

b) a pressure equalizing passageway and dual retention arm means, each of said retention arm means sealed on one end and with an open end fastened to said pressure equalizing passageway that extends through a front portion of said body; said retention means thereby acting to hold said scuba diver mouthpiece firmly in place when said retention arms are gripped between a users' teeth; said retention arms being fabricated from a plastic less than 1/16" in thickness and partially filled with fluid thereby conforming to a surface of users teeth when in use;

c) an air humidifier means removably connectable to said scuba diver mouthpiece;

d) a means to add and to remove said fluid from said retention arm means thereby allowing a user to adjust said retention arms' apparent thickness for most comfortable use.

* * * * *